United States Patent [19]

Weber

[11] 4,323,863

[45] Apr. 6, 1982

[54] N-WAY POWER DIVIDER/COMBINER

[75] Inventor: Robert J. Weber, Marion, Iowa

[73] Assignee: Rockwell International Corporation, El Segundo, Calif.

[21] Appl. No.: 79,616

[22] Filed: Sep. 27, 1979

Related U.S. Application Data

[63] Continuation of Ser. No. 869,877, Jan. 16, 1978, abandoned.

[51] Int. Cl.[3] ..... H01P 5/18

[52] U.S. Cl. ..... 333/109; 333/156

[58] Field of Search ..... 333/100, 109, 113–116, 333/125, 127, 128

[56] References Cited

U.S. PATENT DOCUMENTS

| | | | |
|---|---|---|---|
| 3,091,743 | 5/1963 | Wilkinson | 333/127 |
| 3,103,638 | 9/1963 | Greuet | 333/127 |
| 3,428,920 | 2/1969 | Oleksiak | 333/100 X |
| 3,495,263 | 2/1970 | Amitay et al. | 333/109 X |
| 3,529,265 | 9/1970 | Podell | 333/127 |
| 3,657,561 | 4/1972 | Riekers et al. | 333/133 X |
| 3,729,692 | 4/1973 | Tanaka et al. | 333/109 X |
| 4,129,839 | 12/1978 | Galani et al. | 333/128 |

FOREIGN PATENT DOCUMENTS 497671 3/1976 U.S.S.R. .

*Primary Examiner*—Paul L. Gensler
*Attorney, Agent, or Firm*—George A. Montanye; Richard A. Bachand; H. Frederick Hamann

[57] ABSTRACT

An n-way power divider, particularly useful where $n \neq 2^x$, includes an input and a plurality of outputs. The power applied to the input is coupled to the outputs, and phase shifters are associated with at least some of the outputs. The phase shift provided by each of the phase shifters is determined such that the reflected power waves from each of the outputs appearing at the input cancel. Because the circuit is reciprocal, it can also be used as a signal combiner with appropriately phased power-wave vectors at the inputs.

4 Claims, 6 Drawing Figures

N-WAY POWER DIVIDER/COMBINER

This is a continuation of application Ser. No. 869,877, filed Jan. 16, 1978 now abandoned.

BACKGROUND OF THE INVENTION

1. Field of the Invention

This invention relates to power divider/combiners, and, more particularly, to an n-way power divider/-combiner, particularly useful where $n \neq 2^x$, having zero reflection coefficients at the input for equal output loads.

2. Description of the Prior Art

Power dividers or combiners are networks which either divide power applied to a single input among n outputs, or conversely, combine power applied to n inputs to a single output. The principles applicable to power dividers are equally applicable to power combiners, and, consequently, such circuits will herein be referred to simply as power dividers/combiners.

Power dividers/combiners are used in many varied environments, for example, in optical environments as well as in many electrical uses. For example, in electrical uses, they can be used in waveguide, stripline or discrete component forms, or generally whenever power is desired to be divided or combined. The invention herein is generally applicable to all power divider/-combiner uses, but is disclosed and described herein specifically with respect to stripline or microwave technology.

In the microwave technology environment, dividers are ordinarily constructed with power couplers of stripline material formed on a printed circuit board. Such couplers ordinarily produce a power division into two components, and are generally referred to as "hybrid" couplers.

As is well known, the efficient operation of electrical circuits is dependent upon minimizing the reflected power at the input and output ports of the circuit. One external factor influencing such reflected power is the matching of the load at the output to the circuit. Additionally, because of the power division or combination produced by power divider/combiner circuits, reflections generated by the output loads do not inherently cancel when a division number or combination number of ports of the circuit is not equal to $2^x$. Also, in certain circuits, such as in some particular circuits in which the number of ports are equal to $2^x$, the reflection coefficients inherently cancel, and, therefore, are of no concern. In other circuits, on the other hand, in which the division or combination number is not an exponent of two, or reflection coefficients are otherwise a problem, the reflected power-waves at the input heretofore have largely been ignored as being difficult or impossible to eliminate.

BRIEF DESCRIPTION OF THE INVENTION

In light of the above, it is an object of the invention to provide an improved power divider/combiner.

It is another object of the invention to provide a power divider/combiner which can be used in a network having n division/combination ports where $n \neq 2^x$ or in which power-wave vectors appearing at the input do not cancel.

It is still another object of the invention to provide such power divider where the reflected power seen at an input port totals zero.

It is still another object of the invention to provide a power combiner having ordered inputs and an output, such that if signals applied to the respective inputs have a phase equal to the phase correction of a corresponding inversely ordered input, the vector sum of the reflections at each of the inputs will be zero.

These and other objects, features, and advantages will become apparent to those skilled in the art from the following detailed description when read in conjunction with the accompanying drawings and appended claims.

The invention, in its broad aspect, is a power distribution network of the type having two sets of ports, one of the sets including an input port and another of the sets including a plurality of output ports. The output ports are unequal in number to an exponential power of two. Power transmission means are provided to interconnect the input port and the plurality of the output ports in a manner in which reflected power-wave vectors at the input port totals zero. More specifically, a power distribution network includes power couplers to divide the power applied thereto among the output ports, from the input ports. Phase shifters are included in at least some of the transmission lines to assure that the power which is reflected produces a power-wave vector which cancels in sum with power-wave vectors whereby the total reflected power seen at an input port is zero.

By virtue of the reciprocity of the circuit, power can be applied to a plurality of input ports with reverse phase order from that provided in the respective transmission lines, and the resulting transferred power-wave vectors appearing at the output port will be equal.

BRIEF DESCRIPTION OF THE DRAWING

The invention is illustrated in the accompanying drawing wherein.

DETAILED DESCRIPTION OF THE PREFERRED EMBODIMENTS

Figure 1:
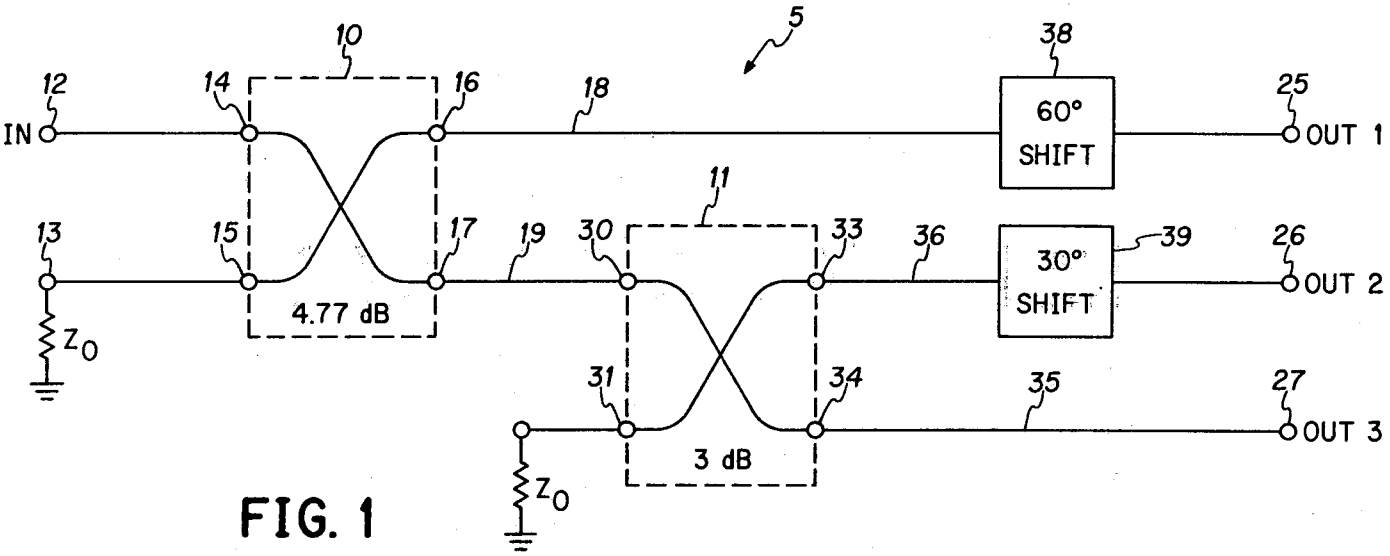
FIG. 1 is an electrical schematic diagram of a 3-way power divider, in accordance with the principles of the invention.

The invention, in its broad aspect, is an apparatus and method for achieving an n-way power divider, or combiner, in which $n \neq 2^x$ (where n is an integer) in which a non-zero reflected power-wave vector occurs. A 3-way power divider embodiment 5 is shown in FIG. 1 and includes a pair of power divider elements 10 and 11 described below in detail. As shown, the power divider 10 receives power from input terminal 12 at its input terminal 14 to divide the applied power for delivery to its output terminals 16 and 17. The input terminal 13 is connected to an appropriate termination impedance $Z_0$, in a manner well-known in the art. Coupler 10 has a coupling coefficient of 4.77 db between the input port 14 and the output port 16. Thus, the power delivered at the output port 17 is two times the power delivered at output port 16, for delivery to the coupler 11. As will become apparent, the power delivered to the second coupler 11 will be equally divided; hence, equal power quantities will be provided to each of the output ports 25, 26, and 27 of the network 5.

The power on line 19 is applied to input terminal 30 of the power divider 11, which delivers the divided power output at output ports 33 and 34. As with the coupler 10, the input terminal 31 is connected to an appropriate termination impedance $Z_0$. The coupler 11 has a coupling coefficient of 3 db between the input terminal 30 and the output terminal 34. Thus, the power delivered onto line 35 is of equal power to that delivered onto output line 36. Therefore, as mentioned, the power delivered to each output port or terminal 25, 26, and 27 is of equal magnitude.

In addition to the amplitude control provided by the couplers 10 and 11, a pair of phase shift means 38 and 39 are provided on output lines 18 and 36, respectively. The design of and requirement for the phase shift provided by the respective phase shift means 38 and 39 can be illustrated with the vector diagram of FIGS. 2 and 3. The vectors shown are chosen, for purposes of illustration, to be so-called "power-wave" or "s-parameter" vectors, having units of the square root of power, as described by K. Kurokawa, "Power Waves and the Scattering Matrix", IEEE Transactions on Microwave Theory and Techniques, Vol. MTT-13, No. 2, March, 1965.

Figure 2:
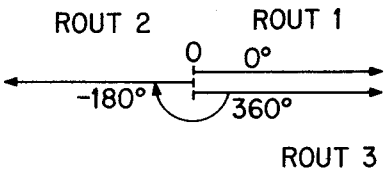
FIG. 2 is a vector diagram of the reflected power-wave appearing at the input terminal of the circuit of FIG. 1, without phase modification in accordance with the invention.

First, assuming that the phase shift provided by the phase shift means 38 and 39 is t°, the output power-wave developed on the output terminals 25, 26, and 27, (assuming the terminals are terminated in an appropriate termination impedance, not shown), will be reflected back to the input, in a fashion illustrated by the vector diagram of FIG. 2 (the origin 0 is shown as an expanded line rather than a point, for clarity). As is known in the art, the coupler 10 produces a 90° phase shift between the input port 14 and the output port 17, and a 0° phase shift between input port 14 and the output port 16. Thus, the input power-wave traversing the coupler 10 on lines 12 and 18 will experience zero phase shift from input to output, and, likewise, zero phase shift in the reflected wave from output to input. The reflected power-wave vector labeled "ROUT 1" will therefore be of 0° relative phase shift with respect to the input (assumed herein to be of 0° phase angle). On the other hand, the input power-wave delivered to line 19 experiences a 90° phase shift in traversing the coupler 10 in the forward direction. The power-wave will thereafter experience a 90° phase shift in traversing the 3 db coupler 11 between ports 30 and 34. (The coupler 11, like coupler 10, produces 90° phase shift between input port 30 and output port 34, and 0° phase shift between input port 30 and output port 33.) The reflected wave from output terminal 26, on the other hand, experiences zero phase shift in traversing the ports 33 and 30 on coupler 11, and 90° in traversing ports 17 and 14 on coupler 10. Thus, the total reflected power-wave at the input port 12 will be 180° relative phase shift from that of the applied input power-wave, as shown by the vector labeled "ROUT 2".

Finally, the input power-wave which is delivered to output terminal 27 experiences 90° phase shift in the cross path traversal of coupler 10, and additional 90° in the cross path traversal of the coupler 11, and, upon reflection, similar 90° phase shifts in couplers 11 and 10. Thus, the total relative phase shift experienced in this power path is 360°, shown by the vector "ROUT 3" which again aligns with the applied input power-wave.

It can be seen from an examination of the vector diagram of FIG. 2 that the power-wave reflections seen at the input terminal 12 are non-cancelling. That is, the sum of the reflected power-waves seen at the input terminal 12 is equal to one power unit with 0° phase shift. Thus, it can be seen that there will be inefficient operation of the circuit of FIG. 1 if operated without compensation for this reflected power-wave.

In accordance with the invention, phase shift means are provided in at least some of the output lines to enable the reflected power-wave to be entirely cancelled. In the embodiment of FIG. 1, for example, a 60° phase shift means 38 is provided in output line 18 and a 30° phase shift means 39 is provided in output line 36.

Figure 3:
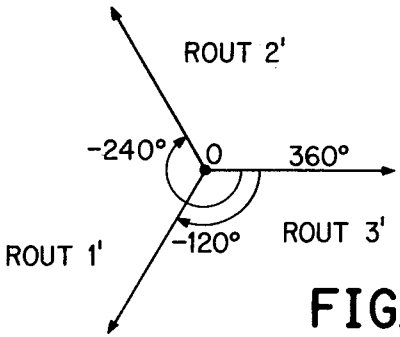
FIG. 3 is a vector diagram of the reflected power-wave of the circuit of FIG. 1, appearing at the input terminal, with phase modification in accordance with the invention.

The reflected power-wave seen at the input port 12 using the 60° and 30° phase shift means 38 and 39 is as shown in FIG. 3. The power-wave delivered to output terminal 25, being shifted 60° in the forward direction and an additional 60° in the opposite direction, experiencing no phase shift within the coupler 10, will be seen as a vector labeled "ROUT 1" at an angle of −120°. By the same manner of operation, the power-wave delivered to output terminal 26 will experience an additional 30° phase shift in each direction in traversing the 30° phase shift means 39, thereby being reflected to the input terminal with a phase shift of −240°, as shown by the vector labeled "ROUT 2'". The reflected power-wave produced at output terminal 27 remains unchanged, and, therefore, will be seen as a vector having an angle of 360°, as shown. Upon examination of the vector diagram of FIG. 3, it can be seen that the various output vectors cancel entirely when added. Thus, the reflected power-wave seen at the input terminal 12 in this embodiment is zero.

Figure 4:
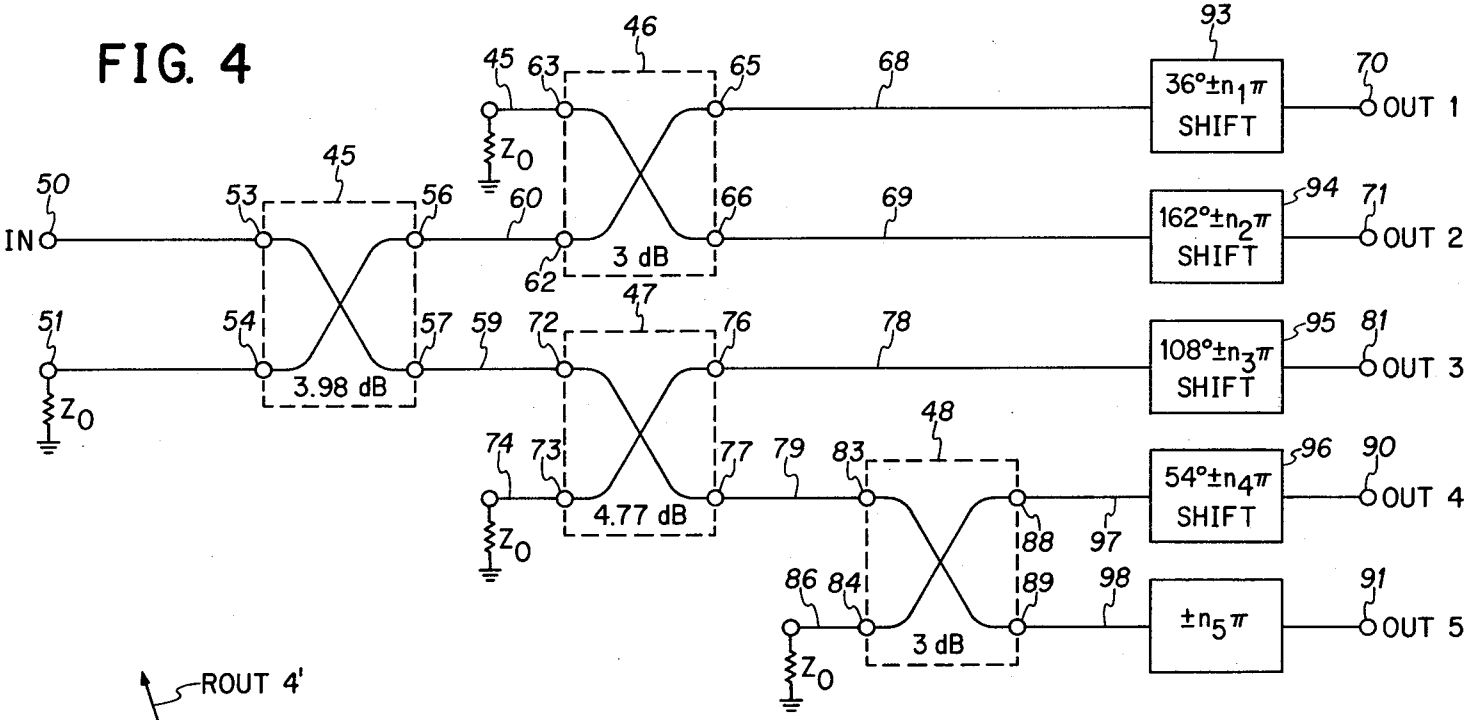
FIG. 4 is an electrical schematic diagram of one embodiment of a 5-way power divider, in accordance with the principles of the invention.

N-way power division apparatus for different values of n can be constructed, in a similar fashion. For example, as shown in FIG. 4, a 5-way power divider includes four hybrid couplers 45, 46, 47 and 48. In this embodiment, the first coupler 45 receives inputs from input terminal 50 at port 53, to produce outputs at ports 56 and 57. The input port 54 is terminated by an impedance $Z_O$, connected between terminal 51 and ground. The coupler 45 serves to divide the input power delivered to output ports 56 and 57 by a ratio of 2:3. Thus, the coupler 45 is designed to produce 3.98 db of coupling between the input port 53 and the output port 56 onto line 60 and 2.22 db of coupling between the input port 53 and the output port 57 onto line 59.

The output power on line 60 is delivered to an input port 62 of the coupler 46, the other input port 63 of which is terminated by an impedance $Z_O$. The outputs of the coupler 46 are developed onto lines 68 and 69 at ports 65 and 66 for delivery with a relationship of one to one, for delivery to output terminal 70 and 71. Thus, the coupler 46 is a 3 db coupler, that equally divides the power between output ports 65 and 66.

On the other hand, the power developed upon line 59 from the coupler 45 is delivered to an input port 72 of the coupler 47, the other input port 73 of which is terminated by an impedance $Z_O$ on line 74. The output from the coupler 47 is developed at output ports 76 and 77 for delivery onto lines 78 and 79 with power relationship of one to two. Thus, the coupler 47 couples 4.77 db between the input port 72 and output port 76 to achieve this one to two relationship. The power developed on line 78 is conducted to output terminal 81, while the output on line 79 is delivered to one input port of coupler 48. The other input port 84 of the coupler 48 is terminated by an impedance $Z_O$ connected between line 86 and ground.

The output from the coupler 48 is derived at outputs 88 and 89 to be delivered, respectively, to output terminals 90 and 91 on lines 97 and 98. Since the power delivered to output terminals 90 and 91 must be equally divided, the coupler 48 is a 3 db coupler.

Figure 5:
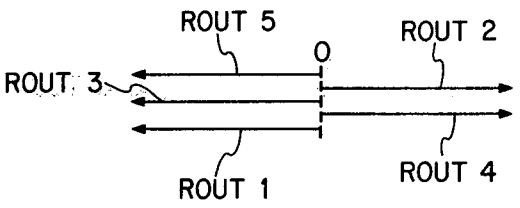
FIG. 5 is a vector diagram showing the respective phases of the reflected power-wave appearing at the input terminal of the circuit of FIG. 4, without phase modification in accordance with the invention.

A plurality of phase shift means, 93, 94, 95 and 96 are provided on lines 68, 69, 78 and 97, respectively, to produce cancellation of the reflected power-wave vectors appearing at the input terminal 50. The design of these phase shift means 93–96 is explained with reference to the vector diagrams of FIGS. 5 and 6 (the origin O of FIG. 5 again being shown as a line instead of a point). With reference now to the vector diagram of FIG. 5, and assuming the phase shift of the respective phase shift means 93–96 is 0°, the output power which is reflected to the input terminal 50 is illustrated. The analysis of the reflected power is similar to that described above with reference to FIG. 1, and will not be described in further detail, other than to note that the reflected power-wave seen at the input terminal 50 from output terminals 71 and 90 is 0° (labeled "ROUT 2" and "ROUT 4" respectively) and from output terminals 70, 81, and 91, is at 180° (labeled "ROUT 1", "ROUT 3" and "ROUT 5", respectively). Thus, again, without appropriate phase shifting, the various output power-wave vectors reflected to the input terminal 50 do not entirely cancel.

As previously explained, in accordance with the principles of the invention, various phase shift means are included upon some of the output terminals. Thus, a 36° phase shift means 93 is provided on line 68; 162° phase shift means 94 is provided on line 69; 108° phase shift means 95 is provided on line 78; and 54° phase shift means 96 is provided on line 97. Line 98 is of unchanged phase.

Figure 6:
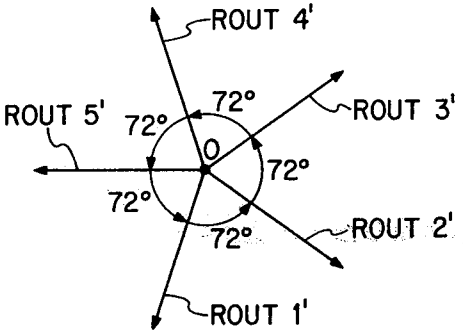
FIG. 6 is a vector diagram showing the reflected power-wave seen at the input terminal, including the phase shift in accordance with the invention.

The effect of the respective phase shift means 93–96 upon the reflected power-waves as seen at the input terminal 50 is as shown by the vector diagram in FIG. 6. As can be seen, the power-wave vectors are displaced each 72° from the other, thereby resulting in total cancellation therebetween to effect, in essence, zero reflected power appearing at the input teminal 50. As before, the vectors in FIG. 6 which represent phase shifted power-wave quantities are shown with a prime (') after the designation thereof.

The invention has thus been described with respect to 3-way and 5-way power divider networks. Similar design criterion can be similarly employed to achieve other n-way power dividers, or, since the circuits exhibit electrical reciprocity, power combiners.

It should be pointed out that the above two examples were described with respect to circuits having equal termination impedances denoted $Z_O$. If it should be desirable in the design of a particular circuit to terminate the various output ports in an impedance which is different from the other output impedances, the techniques above-described to cancel the reflected power-wave vectors are equally applicable. That is, by appropriately choosing the coupling coefficients of the couplers and the phase delay of the respective phase delay means, the reflected power-waves can be made to cancel despite unequal termination impedances.

In addition, as shown in FIG. 4, the amount of delay chosen in the phase delay means of the circuits can be varied by a factor of $n\pi$ without affecting operation of the circuit, n not necessarily having to be the same in each phase delay means.

Although the invention has been described and illustrated with a certain degree of particularity, it is understood that the present disclosure has been made only by way of example, and that numerous changes in the combination and arrangement of parts may be resorted to without departing from the spirit and the scope of the invention as hereinafter claimed.

What is claimed is:

1. A power distribution network comprising:

first port means for receiving power input;

a plurality of second port means for providing outputs, the number of said second port means being equal to an integer which is not equal to an exponential power of two;

power transmission means coupled for transmitting power from said input port means to said plurality of output port means including, power coupler means for controlling the magnitude of the power transmitted to said second port means for providing a plurality of power outputs, each of said second port means providing a reflected power wave appearing at said input port means in response to power transmitted by said power coupler means, and phase shift means coupled for phase shifting selected ones of said power outputs and said reflected power waves, said power coupler means and said phase shift means being constructed and cooperatively arranged to cause the vector sum of said reflected power waves appearing at said input port means to equal zero.

2. A power distribution network comprising:

a first port;

a plurality of second ports, the number of said plurality of second ports being equal to an integer which is not equal to an exponential power of two; and power transmission means coupled for transmitting power between said first port and said plurality of second ports including, power coupler means coupled for distributing the power received at said first port equally between the plurality of second ports, each of said second ports producing a reflected power wave appearing at the input port which is equal in magnitude to the reflected power wave from the other second ports, and a phase shift means coupled to phase shift the power to said second outputs and said reflected power waves so that the vector sum of said reflected power waves at the input port is equal to zero.

3. In a power distribution network having a plurality of input ports and an output port, each of said input ports receiving an input power wave of a predetermined magnitude and phase wherein the number of input ports is equal to an integer not equal to an expotential power of two, and power transmission means coupled for transmitting the power waves from said plurality of input ports to said output port, the improvement in said power transmission means comprising:

power coupler means for controlling the magnitude of power waves transmitted from said input ports to said output port; and phase shift means coupled to phase shift selected ones of said power wave inputs;

said power coupler means and said phase shift means being constructed and cooperatively arranged to cause the vector sum of the power wave inputs appearing at the output port to equal zero.

4. In a power distribution network having an input receiving a power wave and a plurality of outputs and a power transmission means coupled to said input and said plurality of outputs for transmitting power from said input to said plurality of outputs, each of said outputs providing a reflected power wave to said input in response to power transmitted by said power transmission means, wherein the vector sum of said reflected power waves is not equal to zero, the improvement in said power transmission means comprising:

power coupler means for controlling the magnitude of the power transmitted to said plurality of outputs for causing said reflected power waves to be of equal magnitude, and phase shift means coupled for phase shifting said power wave outputs and said reflected power waves so that the vector sum of said reflected power waves appearing at the input is equal to zero.

* * * * *

UNITED STATES PATENT AND TRADEMARK OFFICE

CERTIFICATE OF CORRECTION

PATENT NO. : 4,323,863

DATED : April 6, 1982

INVENTOR(S) : Robert J. Weber

It is certified that error appears in the above–identified patent and that said Letters Patent are hereby corrected as shown below:

Column 2, line 54, delete ", and" and insert a period;
line 63, insert --or-- after ")";
Column 3, line 39, delete "$t^0$" and insert --0--;
Column 4, line 31, change "ROUT 1" to --ROUT 1'--;
Column 6, line 27, delete "input" and insert --first--;
line 28, delete "output" and insert --second--;
line 33, delete "input" and insert --first--;
line 42, delete "input" and insert --first--;
line 56, delete "input" and insert --first--;
line 60, delete "outputs" and insert --ports--;
line 62, delete "input" and insert --first--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*